United States Patent [19]

Youd et al.

[11] Patent Number: 4,840,230

[45] Date of Patent: Jun. 20, 1989

[54] RETRIEVABLE WEDGING SYSTEM FOR COUPLING DOWNHOLE DEVICES INTO CASED BORE HOLES

[75] Inventors: T. Leslie Youd, Orem, Utah; Garrett O. Jackson, Valencia, Calif.

[73] Assignee: Electric Power Research Institute, Inc., Palo Alto, Calif.

[21] Appl. No.: 96,860

[22] Filed: Sep. 14, 1987

[51] Int. Cl.[4] ..... E21B 23/00; E21B 33/129; B25B 1/00

[52] U.S. Cl. ..... 166/382; 166/134; 166/217; 166/385; 294/86.25; 294/96

[58] Field of Search ..... 166/382, 385, 206, 217, 166/243, 134; 294/86.25, 93, 94, 96

[56] References Cited

U.S. PATENT DOCUMENTS

| | | | |
|---|---|---|---|
| 903,314 | 2/1908 | Porter | 166/217 |
| 1,875,357 | 9/1932 | Simmons | 166/217 |
| 2,122,742 | 7/1938 | Hanes | 166/134 |
| 2,623,593 | 12/1952 | Pennington et al. | 166/217 |
| 2,672,200 | 3/1954 | Patterson | 166/206 |
| 2,729,293 | 1/1956 | Cloud | 166/206 |
| 2,756,827 | 7/1956 | Farrar | 166/134 |
| 3,371,741 | 3/1968 | Haxby | 166/206 |
| 3,493,046 | 2/1970 | Johnson et al. | 166/217 |
| 4,313,497 | 2/1982 | Graham | 166/217 X |

*Primary Examiner*—Bruce M. Kisliuk
*Attorney, Agent, or Firm*—Flehr, Hohbach & Test

[57] ABSTRACT

A retrievable downhole wedging system is disclosed for firmly securing accelerometers and other instruments to the bottom of a cased bore hole. The system includes a pair of arcuate top wedges and a pair of arcuate bottom wedges for insertion between the accelerometers and the casing. The bottom wedges are slideably coupled to the accelerometer such that they will not become separated from the accelerometer during retrieval. A retrieving means is provided for disengaging the accelerometer by first individually removing the top wedges and then pulling the accelerometer free of the bottom wedges.

16 Claims, 3 Drawing Sheets

RETRIEVABLE WEDGING SYSTEM FOR COUPLING DOWNHOLE DEVICES INTO CASED BORE HOLES

The present invention relates generally to a system for securely mounting devices to the interior of piping. More particularly, the present invention relates to a retrievable wedging system for mounting devices such as accelerometers downhole in cased bore holes.

There are numerous circumstances where it is desirable to securely mount a device at the bottom of a cased bore hole. One such application involves accelerometers which are placed at the bottom of cased bore holes to detect either seismic activity or acoustic signals applied to the adjacent geological formation to gain useful information as to the structure of the formation. In the past, a wide variety of techniques have been developed to deploy downhole accelerometers at seismic instrument sites. However, such techniques generally render the accelerometers irretrievable or retrievable only with great effort.

One method currently used to mount accelerometers downhole is to directly grout the accelerometer into the soil at the bottom of the bore hole. Another prior art technique is to place the accelerometer at the bottom of the cased hole and then couple the accelerometer to the casing by dropping gravel into the unit hoping to wedge the accelerometer in place. Alternatively, at times cement has been pumped about the unit to grout it into place. Yet another prior art method involves setting the accelerometer into place using wedges that are not easily retrievable. However, in each of these methods, the accelerometer becomes effectively permanently set in the bore hole making it very difficult, if it is at all possible, to retrieve the accelerometer for maintenance for redeployment at another site.

Therefore, it is a primary objective of the present invention to provide a wedging system for firmly mounting a device such as an accelerometer within piping such as that encountered in cased bore holes.

Another object of the invention is to provide a wedging system that can easily be disengaged and retrieved to facilitate maintenance and redeployment of the device.

To achieve the foregoing and other objects and in accordance with the purpose of the present invention, a retrievable wedging system for coupling devices to the interior casing of cased bore holes is provided that includes arcuate top and bottom wedges. A coupling means slideably attaches the bottom wedge to the device. A retrieving means is provided for disengaging the device from the casing and removing both the top and bottom wedges along with the device itself. Preferably a tapered sleeve is provided to form a solid contact surface for the wedges. To lodge the device within a bore hole, the bottom wedge is placed beneath the device, while the top wedge is placed above the device. To firmly secure the device to the bore hole casing, the wedges are arranged with their narrow ends facing toward the device and are drawn toward one another, thereby wedging the device securely to the casing. Preferably, both the top and the bottom wedges are formed from separate pairs of arcuate wedge shaped members.

Preferably the retrieving means include a plurality of coupled cables that are sized and positioned such that when disengaging the device from the casing, the top wedge is lifted first. After the top wedge has been pulled clear of the device, tension is applied to a cable connected to the device itself which may then be retrieved from the casing. When multiple top wedge members are used, it is preferable that the coupled cables be arranged such that the wedge members are pulled individually.

In another preferred aspect of the present invention, the coupling means include a pair of opposing slots disposed within the interior walls of the bottom wedges. A bottom plug that is firmly secured to the device incorporates a cross pin that slideably couples to the slots within the bottom wedge. Thus, when the device is removed from the bore hole, the cross pin slides to the top of the slots and then engages to lift the bottom wedges out as well.

The features of the present invention that are believed to be novel are set forth with particularity in the appended claims. The invention, together with further objects and advantages thereof, may be best understood by reference to the following description taken in conjunction with the accompanying drawings in which:

Figure 1:
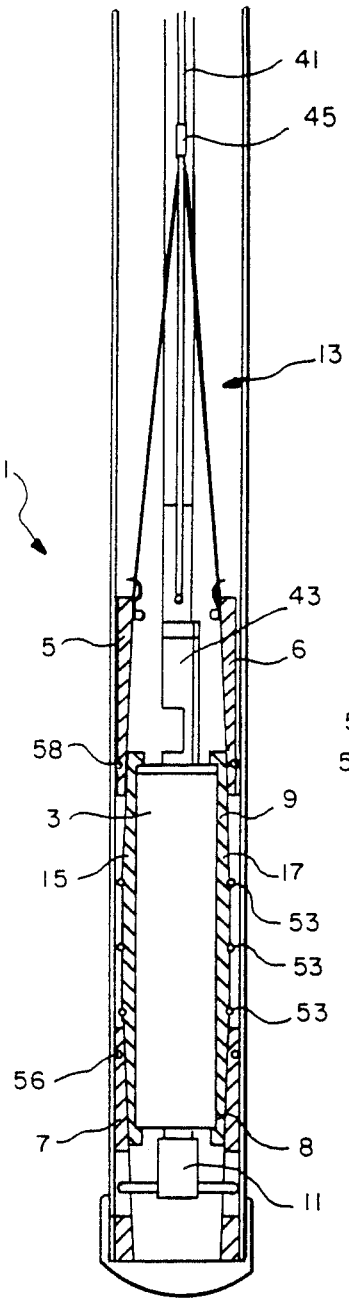
FIG. 1 is a cut away front view of a retrievable wedging system in accordance with the present invention.
Figure 4A:
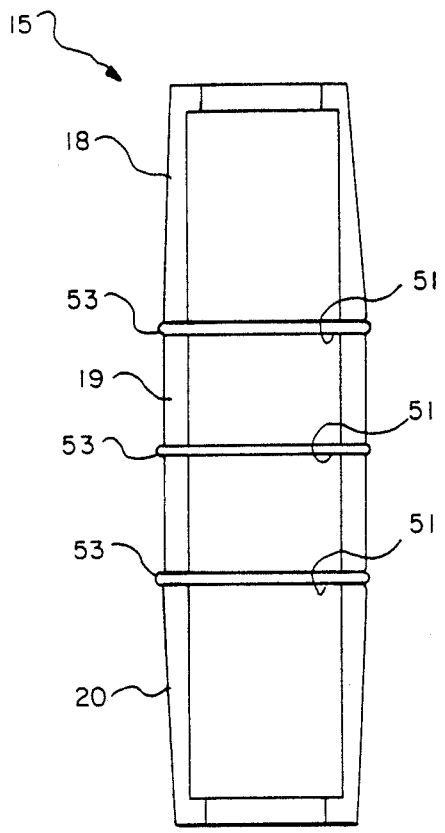

FIG. 4*a* is a partially cut away side view of a sleeve member shown in FIG. 1.

Figure 4B:
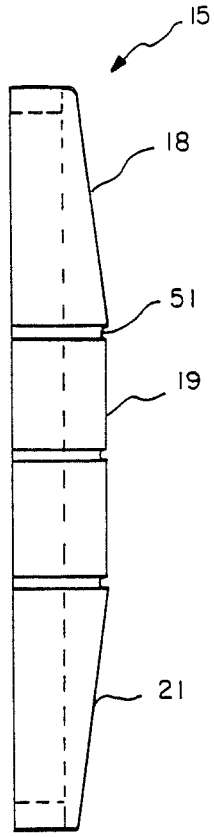

FIG. 4*b* is an edge view of the sleeve member shown in FIG. 4*a*.

Figure 5:
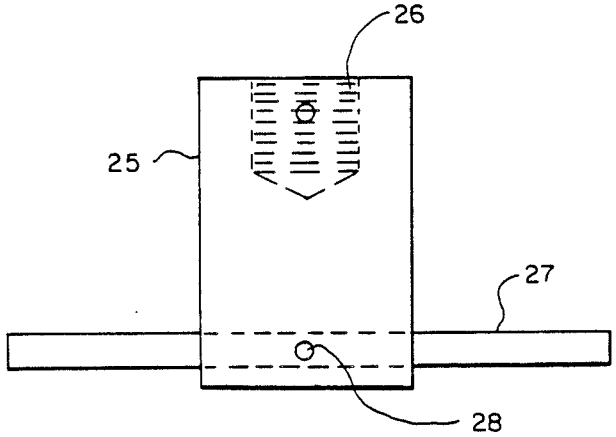

FIG. 5 is an expanded side view of the bottom plug shown in FIG. 1.

Figure 6:
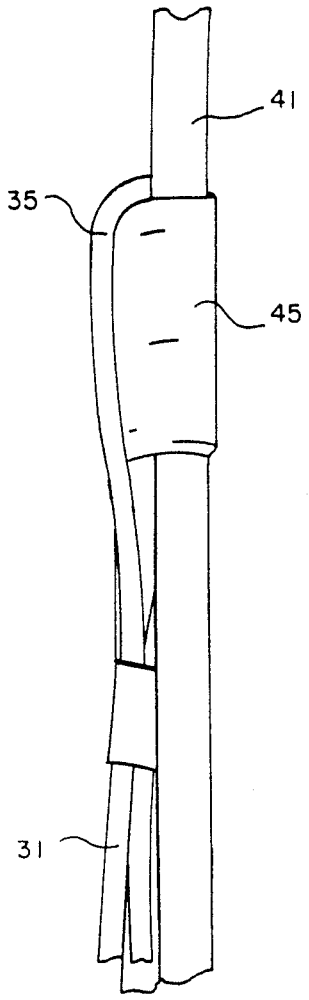

FIG. 6 is an expanded front view of the cable clamping arrangement shown in FIG. 1.

Figure 7:
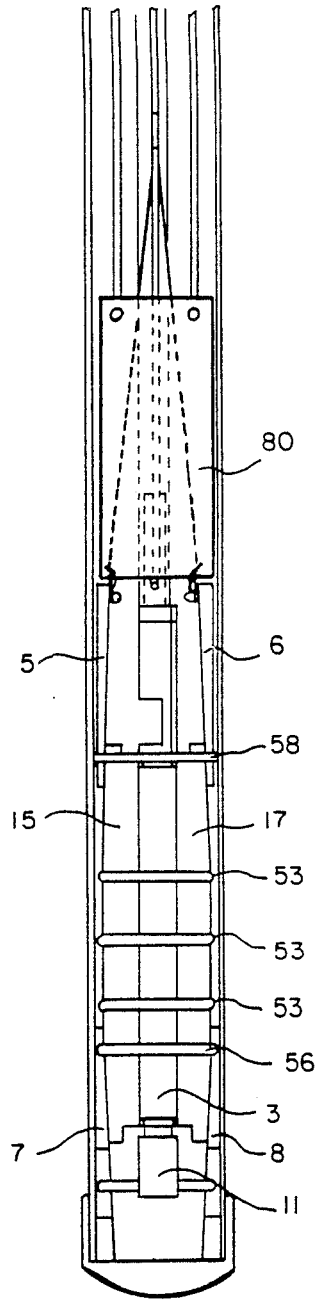

FIG. 7 is a side view of the retrievable wedging system shown in FIG. 1 being set using a tamping tool.

As illustrated in the drawings, the retrievable wedging system 1 for coupling a device 3 to the interior of a pipe such as the bottom of a bore hole casing, includes a pair of arcuate top wedges 5 & 6, a pair of arcuate bottom wedges 7 & 8 and double tapered sleeve 9. Coupling means 11 slideably attaches the bottom wedges 7 & 8 to the device 3. Retrieving means 13 is adapted for disengaging the device 3 from the casing and removing the top and bottom wedges 5–8, as well as the device 3 from the bore hole.

Referring initially to FIG. 1, sleeve 9 includes a pair of double tapered sleeve members 15 and 17 that are journaled about the device 3 to provide a contact surface for wedges 5–8. In the embodiments described herein, the device which is to be coupled downhole is an accelerometer 3. However, it should be appreciated that the wedging system of the present invention could be used to couple any other device to the bottom of a bore hole as well. Therefore, the actual dimensions of sleeve members 15 and 17 may be widely varied to accommodate receiving a particular device 3.

Figure 2:
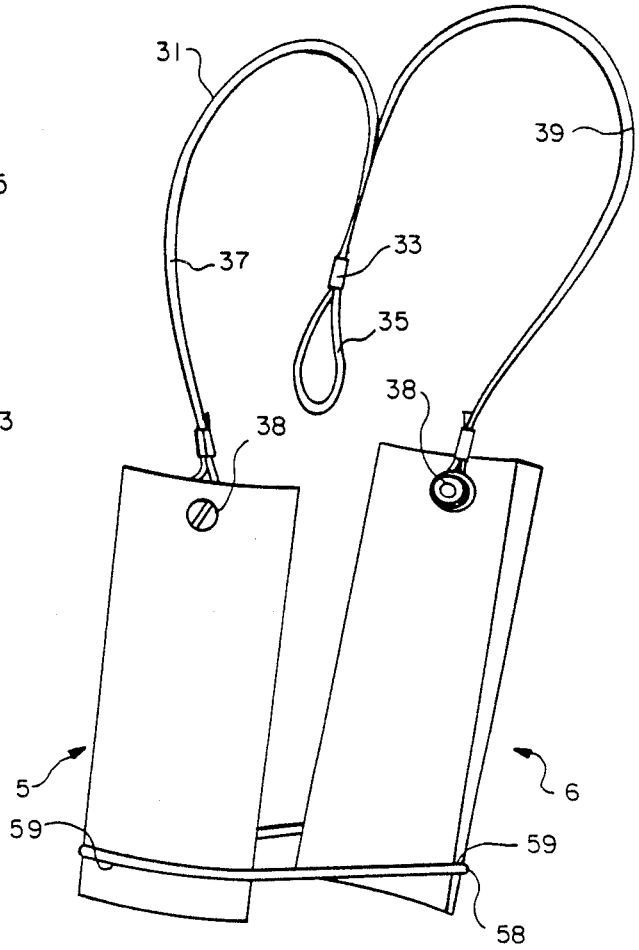
FIG. 2 is an enlarged view of the top wedges shown in FIG. 1.

Referring particularly to FIG. 2, each of the top wedges 5,6 is arcuate and tapers from a thick upper region to a relatively thinner lower region. The wedges 5 & 6 are joined together by a top wedge cable 31 that is clamped together near its middle by clamp 33 to form loop 35, along with short cable portion 37 and long cable portion 39. The long cable portion 39 is approximately one inch longer than the short cable portion. As will be explained below, this feature facilitates releasing the accelerometer from the casing. The ends of cable 31 may be attached to the respective wedges 5,6 in any conventional fashion. By way of example, the cable ends may be looped with the respective looped ends being bolted via nut and bolt combination 38 to the upper region of the top wedges 5,6.

Figure 3:
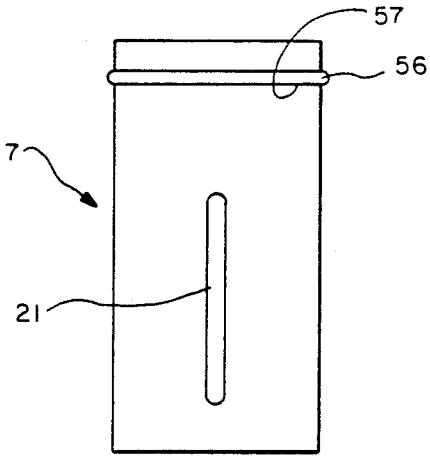
FIG. 3 is an enlarged view of the bottom wedges shown in FIG. 1.

The bottom wedges 7,8 also taper from thick lower region to thinner upper region and are also arcuate. However, as best shown in FIG. 3, each of the bottom wedges 7,8 include a slot 21 that runs longitudinally at about the center of the inner wedge surface. Slot 21 communicates with coupling means 11 in order to keep the bottom wedges 7,8 in place relative to accelerometer 3. reference is next made to FIGS. 4A and 4B, which are detailed views of sleeve member 14. Double tapered sleeve members 145 and 17 may be identical in construction and are arcuate and substantially symmetric. Each sleeve member includes a tapered upper portion 18 which gets gradually thicker toward the middle, a tubular middle portion 19 and a tapered lower portion 20 that gets thinner toward the bottom of the sleeve member. The middle portion 19 preferably includes a plurality of sleeve grooves 51 which are adapted to receive O-rings 53. Once accelerometer 3 is positioned within sleeve members 15 and 17, O-rings 53 are placed about sleeve members 15 and 17 in grooves 51 in order to hold the device together.

Coupling means 11 includes bottom plug 25 and cross pin 27. As shown in FIG. 5, the bottom plug 25 is threaded and adapted to screw onto the bottom end of accelerometer 3. Should accelerometer 3 not have a threaded male plug suitable for engaging threaded port 26 on bottom plug 25, then sleeve 9 may be adapted to include a bottom plate (not shown) having a threaded plug (not shown) suitable for engaging port 26. Cross pin 27 is carried by plug 25 and is sized and positioned such that its opposite ends will slideably couple with the slots 21 in bottom wedge members 7,8. Thus, when the device is assembled, and placed within a casing, the movement of bottom wedges 7,8 relative to accelerometer 3 is limited by the size of slots 21. A lock screw 28 which is threadably recessed within plug 25 secures the cross pin 27 in place.

The retrieving means 13 consists principally of a retrieving cable 41 which is attached to accelerometer 3 in any conventional fashion. Referring specifically to FIG. 6, an installation bracket 43 is bolted to accelerometer 3. The installation bracket 43 is then secured to retrieving cable 41. A cable clamp 45 is attached to retrieving cable 41 a spaced apart distance from the top of installation bracket 43. Loop 35 in cable 31 is wrapped about cable clamp 45, thereby securing the connection between retrieving cable 41 and top wedge cable 31. The length of top wedge cable 31 and the positioning of cable clamp 45 are arranged such that, when retrieving cable 41 is pulled upwards, tension will first come to the short portion 37 of top wedge cable 31. After the first top wedge 5 has been pulled loose, tension comes to the long portion 39 of top wedge cable 31, which in turn pulls the second top wedge 6 free. Only after both top wedges have been liberated is the accelerometer 3 lifted by cable 41, thereby releasing the bottom wedges 7, 8. Coupling means 11, and particularly cross pin 27 ensures that the bottom wedges will be pulled out of the bore hole along with the accelerometer 3.

To set the accelerometer at the bottom of a bore hole, the components are arranged as shown in FIGS. 1 and 7. Specifically, bottom plug 25 is screwed into a threaded aperture (not shown) in the bottom of accelerometer 3. The respective ends of cross pin 27 are inserted into the slots 21 in the pair of bottom wedges 7&8. Sleeve members 15 and 17 are placed about accelerometer 3 and O-rings 53 are placed in sleeve groves 51 to secure the sleeve members to accelerometer 3. Installation bracket 43 is bolted to the top of accelerometer 3 and attached to retrieving cable 41. Top wedges 5, 6 are then positioned over the top of sleeve members 15 and 17. An O-ring 58 that fits within a groove 59 in the lower portion of top wedges 5 & 6 lightly holds the top wedges and the sleeve together. Similarly, an O-ring 56 may be positioned about the upper portion of bottom wedges 7, 8 in groove 57 to keep the bottom wedges from flapping loose. In this extended configuration, the assembled wedging system is ready to be lowered down a cased bore hole.

Preferably the extended wedging system is inserted until the bottom end of bottom wedges 7 and 8 rest at the bottom of the bore hole. Once the accelerometer and wedging system are properly positioned at the bottom of the bore hole, a tamping tool 80 is inserted into the bore hole over retrieving cable 41. Tamping tool 80 is preferably an arcuate piece of heavy pipe that just fits within the bore hole casing. The arcuate cross-section of the tamping tool encompasses about three quarters of a circle. The resultant slot facilitates placing the tamping tool over the retrieving cable 41 and any electrical cables running down to the accelerometer. After insertion over the wire and cable, the tamping tool is lowered into the bore hole until it contacts the wedges. At this point it may be lifted slightly and dropped, or its weight alone may be sufficient to drive the wedges firmly against the tapered sides of sleeve 9 thereby locking the accelerometer into place. The tamping tool 80 may then be removed from the hole. When either maintenance or redeployment of the accelerometer 3 is desired, both the accelerometer and the wedging system may be easily retrieved merely by pulling up on retrieving cable 41 as previously discussed.

Although only one embodiment of the present invention has been described, it should be understood that the present invention may be embodied in many other specific forms without departing from the spirit or scope of the invention. Particularly, it should be appreciated that the specific construction of the top and bottom wedges may be widely varied within the teachings of the present invention. Specifically, in place of the pairs of arcuate top wedges described, a single top wedge or a multiplicity of top wedges could be provided to suit a particular task. The same applies for the bottom wedges. Further, the shape of the sleeve may be widely varied to accommodate any downhole device.

Additionally, it will be appreciated by those skilled in the art that in some circumstances it may not be necessary to independently pull each of the top wedges when retrieving the device. Indeed, the actual coupling of the various wedges to the sleeve for retrieval purposes may be widely varied without degrading the systems performance. Further, it should be appreciated that an accelerometer, or any other devices to be lodged downhole, may be sturdy enough so that no sleeve is needed whatsoever. Therefore, the present examples and embodiment are to be considered as illustrative and not restrictive, and the invention is not to be limited to the details given herein, but may be modified within the scope of the appended claims.

We claim:

1. A retrievable wedging system for coupling a device to the interior of a cylindrical pipe comprising:
a pair of arcuate top wedges for insertion between the device and the pipe;
a first O-ring for disposition about the top wedges to couple the top wedges to said device;
a pair of arcuate bottom wedges for insertion between the device and the pipe, said bottom wedges opposing said top wedges, whereby said top and bottom wedges cooperate to lock the device to said pipe when they are pressed together;
coupling means for slideably coupling the bottom wedges to the device;
retrieving means for disengaging the device from the cylindrical pipe and removing the top and bottom wedges and the device from the pipe, said retrieving means being arranged such that when said device is removed from the pipe, the retrieving means initially disengages said top wedges from said device and moves said device only after said top wedges have been disengaged but before said bottom wedges are moved.

2. A retrievable wedging system as recited in claim 1 further comprising a sleeve attached to and encasing the device, the sleeve forming a contact base for the top and bottom wedges.

3. A retrievable wedging system as recited in claim 2 wherein the top and bottom wedges are positioned such that when they are pushed together, they each press against both the pipe and the sleeve to firmly secure the device to the pipe.

4. A retrievable wedging system as recited in claim 3 wherein the sleeve includes a pair of double tapered sleeve members, wherein the top and bottom wedges each contact the sleeve members along the tapered portions thereof and the angle of inclination of the tapered portions of each said sleeve member substantially matches the angle of inclination of the particular top or bottom wedge that it contacts.

5. A retrievable wedging system as recited in claim 1 wherein each said top wedge includes a groove for receiving said first O-ring.

6. A retrievable wedging system as recited in claim 1 wherein said coupling means includes a second O-ring for disposition about said bottom wedges to press said bottom wedges against said device.

7. A retrievable wedging system as recited in claim 6 wherein each said bottom wedge includes a groove for receiving said second O-ring.

8. A retrievable wedging system for coupling a device to the interior of a cylindrical pipe comprising:
a pair of arcuate top wedges for insertion between the device and the pipe;
a pair of arcuate bottom wedges for insertion between the device and the pipe, whereby the top and bottom wedges are used to couple the device to the pipe;
coupling means for slidably coupling the bottom wedges to the device;
retrieving means for disengaging the device from the cylindrical pipe and removing the top and bottom wedges and the device from the pipe;
a sleeve attached to and encasing the device, the sleeve including a pair of double tapered sleeve members that form a contact base for the top and bottom wedges, each said sleeve member including a plurality of sleeve grooves wherein the top and bottom wedges are positioned such that when they are pushed together, each said top and bottom wedge presses against both the pipe and the sleeve to firmly secure the device to the pipe; and
a plurality of O-rings for coupling said sleeve members to the device wherein each said sleeve groove is adapted to receive one of the O-rings.

9. A retrievable wedging system for coupling a device to the interior of a cylindrical pipe comprising:
a pair of arcuate top wedges for insertion between the device and the pipe;
a first O-pipe for disposition about the top wedges to couple the top wedges to said device;
a pair of arcuate bottom wedges for insertion between the device and the pipe, said bottom wedges opposing said top wedges, whereby the top and bottom wedges cooperate to lock the device to the pipe;
coupling means for slidably coupling the bottom wedges to the device;
retrieving means for disengaging the device from the cylindrical pipe and removing the top and bottom wedges and the device from the pipe, the retrieving means including,
a retrieval cable coupled to the device and
cable means coupled to the retrievable cable for connecting the top wedges to the retrieval cable, said cable means being arranged such that when tension is applied to said retrieval cable to retrieve the device, the cable means causes a first one of the top wedges to be initially disengaged, and a second one of the top wedges is disengaged after said first wedge but before the device is moved.

10. A retrievable wedging system as recited in claim 9 wherein said device is an accelerometer.

11. A retrievable wedging system for coupling a device to the interior of a cylindrical pipe comprising:
a pair of arcuate top wedges for insertion between the device and the pipe;
a pair of arcuate bottom wedges for insertion between the device and the pipe, said bottom wedges opposing said top wedges, whereby said top and bottom wedges cooperate to lock the device to said pipe, each said bottom wedge including a longitudinal slot;
coupling means for slidably coupling the bottom wedges to the device, said coupling means including,
a cross pin adapted to slidably engage said longitudinal slots for allowing restricted vertical movement between each bottom wedge and the device, and
a plug that carries the cross pin and is adapted to threadably engage the device; and
retrieving means for disengaging the device from the pipe and removing the top and bottom wedges and the device from the pipe.

12. A retrievable wedging system as recited in claim 11 wherein said coupling means further include an O-ring for disposition about said bottom wedges to press said bottom wedges against said device.

13. A retrievable wedging system as recited in claim 12 wherein each said bottom wedge includes a groove for receiving said O-ring.

14. A retrievable wedging system for coupling a device to the interior of a cylindrical pipe comprising:
a wedge-shaped top wedge;
a wedge-shaped bottom wedge arrangement, said bottom wedge arrangement opposing said top wedge, whereby to lodge said device within the pipe, said bottom wedge arrangement is positioned substantially on a first side of said device with the narrow end of the bottom wedge arrangement facing towards the device and said top wedge is positioned substantially on a second side of said device with the narrow end of the top wedge facing towards the device, said top wedge and said bottom wedge arrangement being pushed together to secure the device to the casing;

coupling means for slidably connecting the top wedge arrangement to the device; and retrieving means for disengaging the device from the cylindrical pipe and for removing said top wedge, said bottom wedge arrangement and said device from the pipe, the retrieving means including a first cable and a second cable that are connected together, said first cable being attached to said top wedge and said second cable being connected to said device, the first and second cables being sized such that when tension is applied to the cables for removing said top wedge and said device from the bore hole, the top wedge is pulled first, and the device is pulled only after the top wedge has been disengaged.

15. A method of releasably coupling a device to a bore hole casing and subsequently retrieving the device comprising the steps of:

coupling a pair of bottom wedges to the bottom of the deice and a pair of top wedges to the top of the device;

inserting the device together with the top and bottom wedges into the bore hole and lowering the device until the bottom wedges contact the bottom of the borehole;

setting the device by pushing the top wedges towards the bottom wedges to lock the device in place against the casing; and retrieving the device by pulling on a retrieving cable that is connected to both of the top wedges and to the device whereby when tension is applied to the retrieving cable, a first one of the top wedges is disengaged before any tension is applied to move the second top wedge or the device, and then the second top wedge is disengaged before any tension is applied to lift the device itself.

16. A retrievable wedging system for coupling accelerometers to the bottom of a cased borehole, said wedging system comprising:

a pair of arcuate top wedges for insertion between the accelerometer and the casing, each said top wedge including a top wedge groove;

a pair of arcuate bottom wedge for insertion between the accelerometer and the casing, each said bottom wedge including a bottom wedge groove and a longitudinal slot;

a sleeve attached to and encasing the accelerometer, the sleeve including a pair of double tapered sleeve members that form a contact base for the top and bottom wedges, each said sleeve members including a plurality of sleeve grooves;

a first O-ring for disposition about said top wedges to couple said top wedge to said sleeve members, said first O-ring being received by said top wedge grooves;

a second O-ring for disposition about said bottom wedges to press said bottom wedge against said sleeve members, said second O-ring being received by said bottom wedge grooves;

a plurality of sleeve O-rings for coupling said sleeve members to the device wherein each said sleeve groove is adapted to receive one of said sleeve O-rings;

coupling means for slidably coupling said bottom wedges to the casing, said coupling means including a cross pin adapted to slidably engage said longitudinal slots for allowing restricted vertical movement between each bottom wedge and the accelerometer; and retrieving means for disengaging the wedges to release the accelerometer and removing the top and bottom wedges and the accelerometer from the borehole.

* * * * *